United States Patent [19]

Nodskov et al.

[11] Patent Number: 4,580,375

[45] Date of Patent: Apr. 8, 1986

[54] COLLAPSIBLE EXHIBIT PANEL

[76] Inventors: Preben Nodskov, No. 5 Thyrasvej, Rungsted Kyst 2960; Finn Thelander, No. 59 Mortenstrupvej, Horsholm 2970, both of Denmark

[21] Appl. No.: 616,826

[22] PCT Filed: Sep. 20, 1983

[86] PCT No.: PCT/DK83/00087

§ 371 Date: May 18, 1984

§ 102(e) Date: May 18, 1984

[87] PCT Pub. No.: WO84/01094

PCT Pub. Date: Mar. 29, 1984

[30] Foreign Application Priority Data

Sep. 24, 1982 [DK] Denmark ..... 4248/82

[51] Int. Cl.[4] ..... A47F 5/13; E04B 2/74

[52] U.S. Cl. ..... 52/109; 52/646; 40/610

[58] Field of Search ..... 52/109, 82, 80, 646; 74/521; 182/69, 152, 141, 157; 135/109, 110; 40/610

[56] References Cited

U.S. PATENT DOCUMENTS

| | | | |
|---|---|---|---|
| Re. 31,641 | 8/1984 | Derus | 52/82 |
| 415,667 | 11/1889 | Edwards | 52/109 |
| 445,193 | 1/1891 | Osborn | 52/109 |
| 1,095,391 | 5/1914 | Fogle | 52/109 |
| 3,053,351 | 9/1962 | Fulcher | 52/80 |
| 3,381,923 | 5/1968 | Berry | 52/109 |
| 3,710,806 | 1/1973 | Kelley | 52/109 |
| 3,978,634 | 9/1976 | Mack | 52/646 |
| 4,241,746 | 12/1980 | Rothe | 52/80 |
| 4,437,275 | 3/1984 | Zeigler | 52/109 |

FOREIGN PATENT DOCUMENTS

| | | | |
|---|---|---|---|
| 1126633 | 11/1956 | France | 52/109 |

*Primary Examiner*—John E. Murtagh

*Attorney, Agent, or Firm*—Bernard, Rothwell & Brown

[57] ABSTRACT

A collapsible lightweight exhibit panel is composed of mainly square units of pivotally connected rods, each unit being formed as a box-like frame having two opposed mainly parallel and flat vertical unit surfaces for the arrangement of posters, and horizontal and vertical side faces defined by two rods pivotally connected in a scissor-like manner, the ends of said rods being pivotally connected with corner joints located at the unit surfaces. A central joint in the unit is connected with four corner joints at one unit face through diagonally extending rods which are pivotally connected with diagonal rods to the corner joints at the opposite unit face. Corner joints at one unit face are connected in a similar way with central joints in one or more adjacent units and a releasable locking device is provided between one pair of opposed corner joints to form a connection in the erected condition of the panel. In the erected condition of the panel the unit has a substantially trapezoidal cross-sectional form, and all rods, joints and locking device in each unit are located entirely between the unit surfaces with the pivotal connections in the side faces and in the diagonally extending rods being positioned substantially in a vertical central plane parallel to the unit surfaces. Thereby, different panel structures can be built, of which one and the same unit design, and posters can be arranged at both sides of the panel.

5 Claims, 16 Drawing Figures

COLLAPSIBLE EXHIBIT PANEL

TECHNICAL FIELD

The invention relates to a collapsible lightweight exhibit panel of the kind composed of mainly square units of pivotally connected rods.

DESCRIPTION OF THE PRIOR ART

On the basis of general principles for the configuration of collapsible lightweight structures, as exemplified in U.S. Pat. No. 3,968,808, prior art exhibit panels have been made which are formed from units each having a box-like frame with front and rear vertical unit surfaces extending in mainly parallel flat relationship, and with horizontal and vertical side faces, each of which is defined by two side rods pivotally connected with each other in a scissor-like manner. The ends of the side rods are each pivotally connected at its opposite ends with corner joints located in the respective central joint connected with the four corner joints in the rear unit face by substantially diagonally extending rods. Link rods are pivotally connected to the four front corner joints of the unit front face and to intermediate pivotal joints on the corresponding diagonal rods. Corner joints and side rods are common with corresponding adjacent units so that corner joints on a common side between adjacent units are connected to pairs of diagonal rods and link rods of the adjacent units.

This type of prior art collapsible exhibit panel is made self-supporting by selecting a ratio of the length of the link rods relative to the length of the diagonal rod sections between the corner joints and the pivotal joints to the link rods which is different from the ratio of the length of side rod sections from front corner joints to scissor joints relative to the length of side rod sections from rear corner joints to the scissor joints. The self-supporting effect is caused by the fact that the diagonal rods between a central joint located inside the unit and four corner joints due to the action of link connections to the four remaining corner joints are exposed during erection or unfolding of the panel to an increasing bending action until a switch-over position is achieved, in which this bending action is at a maximum.

After passage of the unstable switch-over position the system occupies by itself a stable erected condition in which the diagonal rods extend substantially in a common plane in an equal load balance with the scissor-like rod systems in the unit side faces. Since as a result thereof a considerable stress arises in the diagonal rods during unfolding and folding by the passage of the unstable switch-over position, the operation of the panel requires quite a considerable exercise of force, and by the use of thin-walled light metal tubes for the rod connections of the panel there is a considerable risk of deformation. The central joint and the diagonal rods in the erected condition extend substantially in the above mentioned common plane. As a result of the fact that the panel is designed also with a central joint for the link rods which extend past their pivotal connections with the diagonal rods, this asymmetric structure of the unit entails that for each unit the latter central joint will be located outside the unit frame, so that one surface of the erected panel is not usable for the arrangement of posters.

Moreover, since the known panel mentioned above is only kept in the erected condition by the self-supporting effect described, there will be a rather narrow limit to the load which may be applied to the panel without risk of collapse.

In a similar manner, another exhibit panel known from U.S. Pat. No. A-4,276,726 is designed to be generally unsymmetrical with a single central joint located rather close to the unit surface constituting the front side of the panel intended for the arrangement of posters. In this case, the asymmetric structure makes the unit less suited for the construction of high exhibit panels because the front and rear surfaces of the panel will be unequally loaded, particularly when posters are arranged on the front surface, whereby permanent obliquities may arise.

The prior art panels have been designed in either curved or flat structures, in which the individual units have converging vertical sides in the curved structures, and wherein the vertical sides in the flat structures extend in a planar parallel relationship. Thus, with a given unit design one is limited to one particular structure, whereby it will usually be necessary for the user to carry with him a number of panel structures in order to be able to adapt the construction of exhibit panels to the space conditions prevailing in a particular exhibition room.

SUMMARY OF THE INVENTION

It is an object of the invention to avoid these disadvantages limiting the practical use of the known panels and to provide an exhibition panel which under all conditions offers the possibility of arrangement of posters on both surfaces of the panel, on one hand, and makes it possible for the users, on the other hand, to build up panels arbitrarily in different structures having a curved flat or S-shaped form in dependence on the arrangement and architecture of the exhibition room, with one and the same unit design.

According to the invention, in order to achieve this an exhibit panel of the kind mentioned is characterized in that all rods, joints and locking devices in each unit are located entirely between the unit surfaces in the erected condition of the panel with the pivotal connections in the horizontal and vertical side faces as well as the pivotal joints in the diagonally extending rods being positioned substantially in a vertical central plane parallel to the unit surfaces, that the unit has a substantially trapezoidal horizontal cross-sectional form in the erected condition with a smaller horizontal distance between the corner joints at one unit surface relative to the other, that at least each corner joint is easily detachably connected with all the associated rods, that a snap locking device releasably secures a pair of opposed corner joints in an erected condition, and that tubular members with coupling nuts on the ends thereof connect threaded pins of a plurality of opposed joints distant from the snap locking device.

As a result of the combination of these features, the panel may be adapted in situ, i.e. on the exhibition stand, to the prevailing conditions, since by arranging all units in the same direction, a structure will be obtained having a curved form, whereas by turning every second unit in the horizontal direction a flat configuration will be obtained. Thereby the user may avoid the necessity of carrying on a collection of different panel configurations.

Moreover, with respect to the load conditions, the panel according to the invention provides an improved symmetry, so that the risk for deformation is smaller. As a result of the symmetrical construction with all pivotal connections located substantailly in the vertical central plane of the unit, internal stress in the unit rods will arise neither during unfolding or folding of the panel, nor when the panel is kept in the erected condition, and unfolding and folding may be performed at a minimal exercise of force with a small risk of deformations. Even if deformations or injuries may occur, it is furthermore relatively simple to replace individual rods in the panel as a result of the easily detachable joints.

Since the stability in the erected condition of the panel according to the invention is obtained by threaded connecting members forming stable connections between the joints of each of an arbitrary number of pairs of opposed corner joints, the stability of the panel may easily be adjusted to the actual load by proper selection of the number of connecting members to be used.

A further improved symmetry may be obtained in that the rods pivotally connected with the diagonally extending rods are connected with a further central joint which is likewise located between the unit surfaces.

For the arrangement of posters on the two panel surfaces, use is normally made of the corner joints in the same manner as in the known panels, the unit area being adapted to a standard poster size of 75×75 cms, for instance.

For curved panel configurations according to the invention, an improved flexibility by which also the central joints in adjacent units may be used together with the corner joints for the arrangements of posters may be obtained in that the central joints are positioned at such a distance from said central plane that in a curved panel structure those central joints in adjacent units positioned closest to the concave front surface of the panel are co-plannar with the corner joints between said adjacent units.

Although the basic portion of a panel according to the invention is an individual unit, commercial designs of the panel will normally be composed of several units which in the erected condition will be located above each other in a number of juxtaposed panel sections.

According to a further development of the invention there may be obtained based upon the above mentioned general structural principles, particularly for greater panels, a very flexible design with a small increase of the number of rods in the entire panel in that each section constitutes a separate entity, in which the rods connected in a scissor-like manner only in horizontal side faces are common to two adjacent units, and the corner joints at the opposed vertical side faces of two adjacent units are connected by separate releasable coupling members.

With coupling members of this kind the panel sections or groups of sections may be juxtaposed to greater panels without detachment of the corner joints in the vertical side faces of adjacent sections, removal of the corner joints and the scissor-like rod system in the vertical side face of one section and subsequent introduction of the released rod ends in the corner joints of the other section.

In a panel composed of such sections the separate sections are unfolded individually and coupled together by the separate coupling members, whereby the erection of test configurations before determination on a final panel configuration for a particular exhibition is facilitated. Moreover, the sections can be joined together in a closed tower-like configuration by connecting only the corner joints at the rear side of the panel sections.

BRIEF DESCRIPTION OF THE DRAWINGS

In the following the invention will be further explained with reference to the schematical drawings, in which.

DESCRIPTION OF PREFERRED EMBODIMENTS

Figure 1:
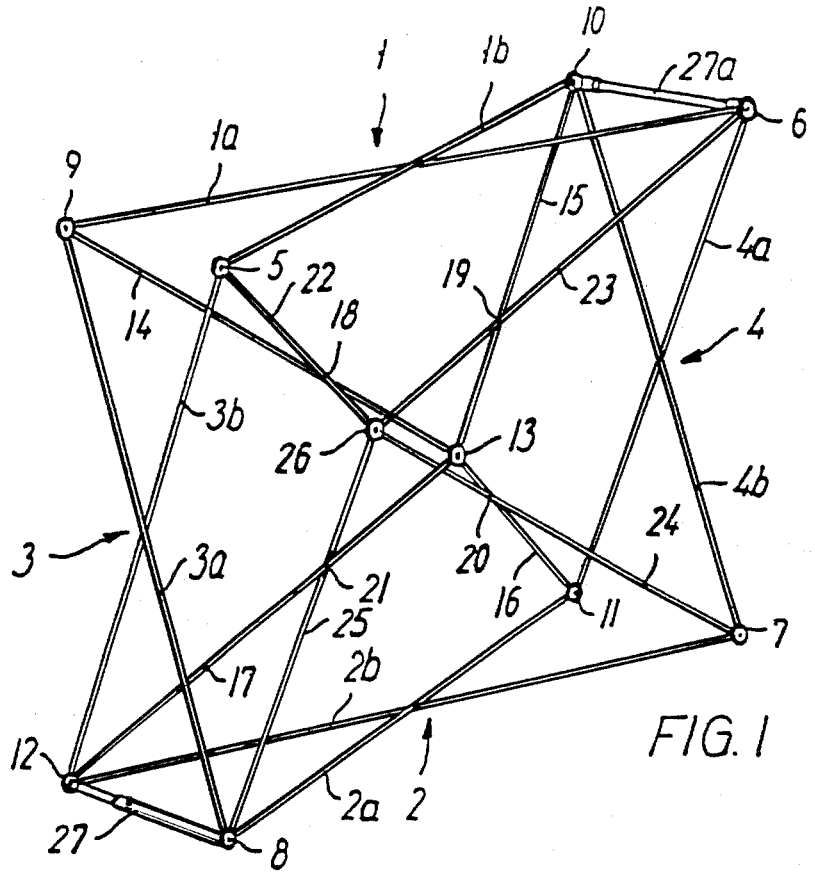
FIGS. 1 to 3 show an embodiment of an individual unit in an exhibit panel according to the invention in perspective, side and plan views, respectively.
Figure 2:
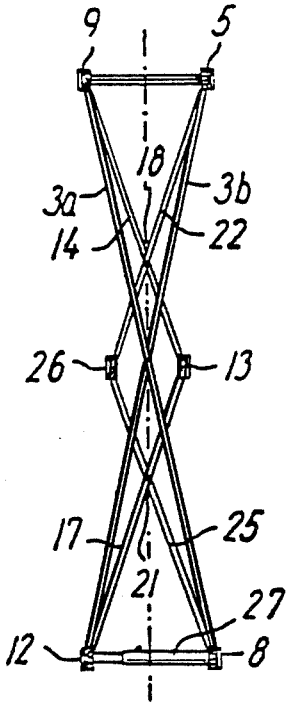
Figure 3:
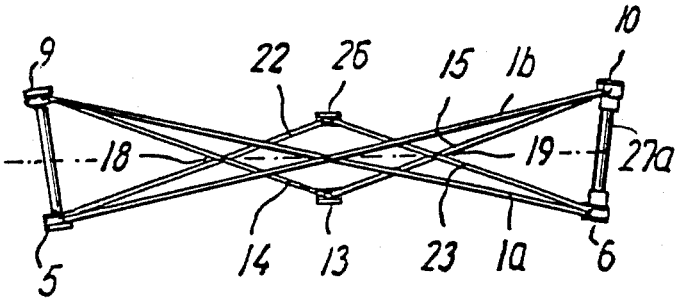

In FIGS. 1 to 3 a unit for an exhibit panel according to the invention is shown in an erected condition. The unit is formed as a box-like frame, the opposed horizontal and vertical side faces of which 1, 2 and 3, 4, respectively, are each formed of two equally long rods designated 1*a* and 1*b* for the side face 1, and in a corresponding manner for the remaining side faces. In a central point the rods in each side face are pivotally connected in a scissor-like manner. In their ends each of the rods 1*a*, 1*b* ... 4*a*, 4*b* which are preferably constituted by relatively thin-walled aluminium tubes having an external diameter of 8 mms, for instance, is pivotally connected with corner joints at one and the other, respective, of the unit surfaces extending substantially in a planar parallel relationship.

In this manner, the corner joints 5, 6, 7 and 8 at one unit surface designated in the following as the front surface of the unit are pivotally connected with the rods 1*b* and 3*b*, the rods 1*a* and 4*a*, the rods 2*b* and 4*b* and the rods 2*a* and 3*a*, respectively. Similarly, the corner joints 9, 10, 11 and 12 at the opposite unit surface designated in the following as the rear surface of the unit are pivotally connected with the rods 1*a* and 3*a*, the rods 1*b* and 4*b*, the rods 2*a* and 4*a* and the rods 2*b* and 3*b*, respectively.

A central joint 13 in the unit is pivotally connected with one end of each of four diagonally extending rods 14, 15, 16 and 17, the opposite ends of which are individually pivotally connected with a respective one of the corner joints 9 to 12 at the rear surface of the unit. In pivotal joints 18, 19, 20 and 21 between the central joint 13 and the corner joints 9 to 12 the rods 14 to 17 are individually connected with a respective one of four correspondingly diagonally extending rods 22, 23, 24 and 25, respectively, which are individually pivotally connected with a respective one of the corner joints 5 to 8 at the front surface of the units. In their opposite ends also the rods 22 to 25 are pivotally connected with a central joint 26. The diagonally extending rods 14 to 17 and 22 to 25 are preferably made of aluminium tubes in the same manner as the rods 1*a*, 1*b* ... 4*a*, 4*b* in the scissor-like connections in the side faces of the box-like unit frame.

Each pivotal connection between two rods to form a scissor-like rod pair can be made in a manner known per se, such as by means of pins, rivets or the like.

By combination of the panel unit as shown with a number of similar units to a panel configuration, some of the corner joints 5 to 12 will in the manner described above be connected to central joint in one or more adjacent units or, expressed in another way, one or more of the side faces 1 to 4 of each unit will be common to two adjacent units.

In order to enable a simple and quick locking in the illustrated erected condition of the unit, a releasable locking device 27, the detailed construction of which will appear from the following, forms a rigid connection for a single pair of opposed corner joints of the front and rear surfaces of the unit, such as the corner joints 8 and 12 in FIG. 1.

Figure 16:
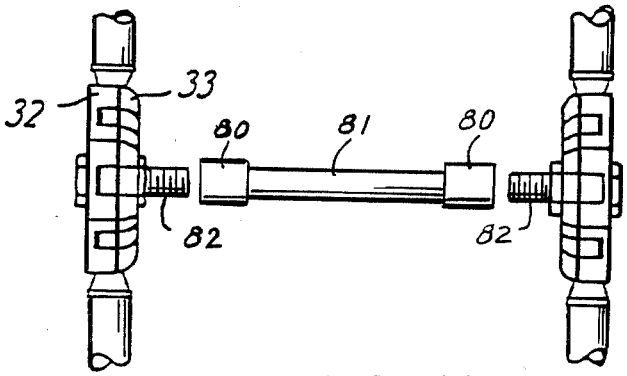
FIG. 16 details a stable connector for securing opposite corner joints together.

In a greater panel a number of stable connections is furthermore formed by means of distant members which as shown at 27*a* in FIG. 16 may comprise a tubular member 81 rotatably connected in both ends with a coupling nut 80 which is screwed onto a threaded pin 82 secured to each of the corner joints.

As more clearly shown in FIGS. 2 and 3, the panel unit in FIG. 1 is designed such that all rods including the rods 1*a*, 1*b* ... 4*a*, 4*b* in the scissor-like connections in the unit side faces 1 to 4, as well as the diagonally extending rods 14 to 17 and 22 to 25 together with all the joints including the corner joints 5 to 12 as well as the central joints 13 and 26 and the locking device 27 and all distance members 27*a* are entirely located between the unit surfaces in the erected condition of the unit and in such a way that the pivotal connections between the rods of each scissor-like rod pair in the unit side faces 1 to 4, as well as the pivotal joints 18 to 21 are located substantially in a vertical central plane parallel to the unit surfaces, such as shown by dot-and-dash lines in FIGS. 2 and 3.

Moreover, as shown in FIG. 3, the unit has a substantially trapezoidal horizontal cross-section in the ercted condition with a smaller horizontal distance between the corner joints such as 5 and 6 at one unit surface, in this case the front surface of the unit, than at the other.

As it will be more readily apparent from the following, it is moreover a characteristic feature of the design that at least the corner joints 5 to 12 are easily detachably connected with all rods associated therewith and belonging to one or more units.

With this design, in which no rods or joints are positioned outside the unit frame, both the front and rear surfaces of a panel composed of such units may be utilized for the arrangement of posters, which may be of essential importance when considering the space conditions prevailing in many exhibition rooms.

Furthermore, as it will appear from the following, an exhibit panel composed of units as shown in FIG. 1 may be designed in different configurations with respect to the basic form without any changes of the unit. As a result of the easy detachability of the joints, the adaption may be performed in situ, i.e. on the exhibition stand, in dependence of the form and architecture of the exhibition room and its division into stands for various exhibitors. As a result, the exhibitor will avoid the necessity of carrying with him a collection of panels of different configurations.

In addition, the symmetry with respect to loading following from the design of the unit entails a smaller risk of deformation of the rod connections constituted by aluminium tubes, particularly with respect to the known panels of the kind mentioned in the foregoing.

Figure 4:
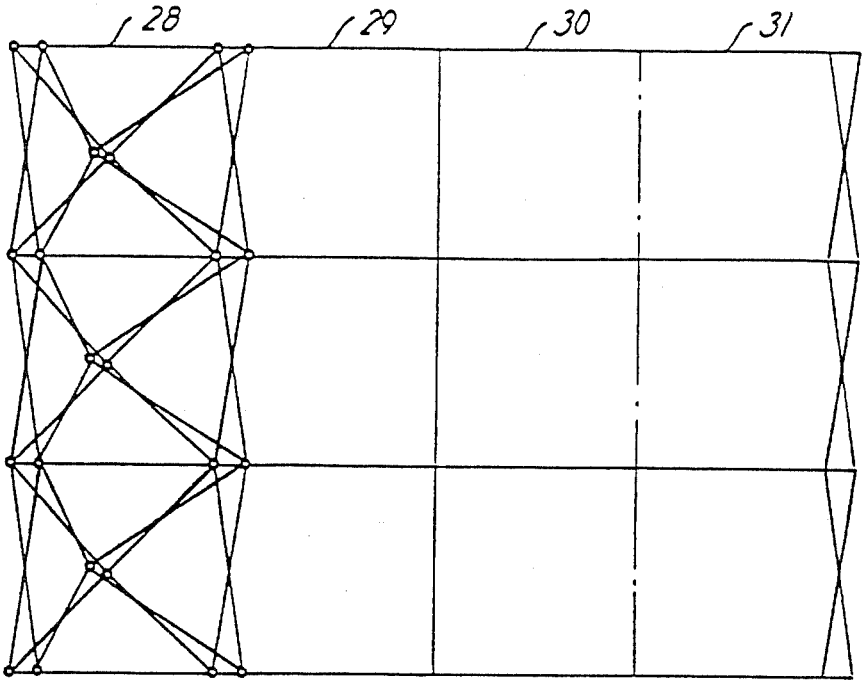
FIGS. 4 to 6 show a curved panel configuration composed of units as shown in FIGS. 1 to 3.
Figure 5:
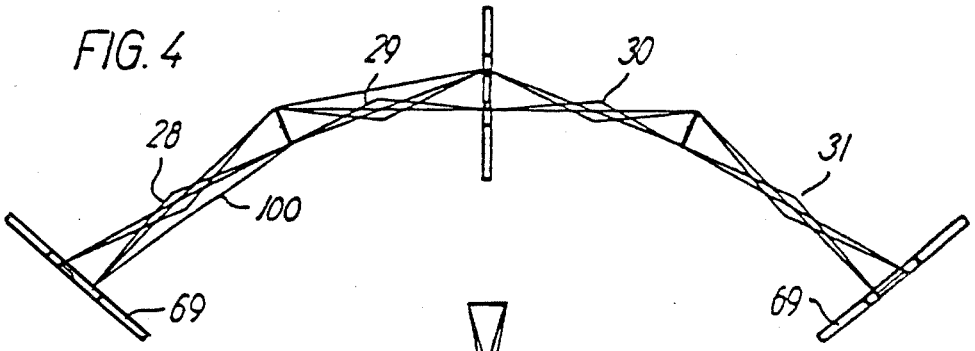
Figure 6:
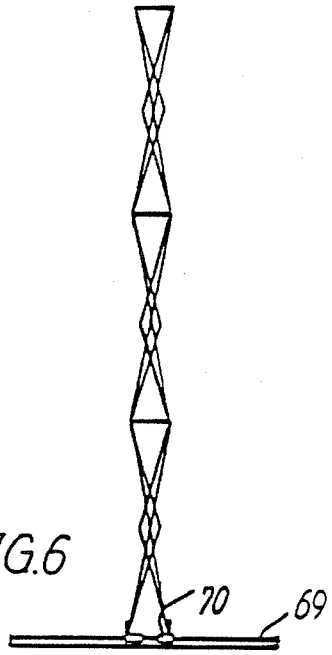

In FIGS. 4 to 6 an example is shown of an exhibit panel having a curved form composed of four juxtaposed vertical panel sections 28, 29, 30 and 31, each comprising three units of the design shown in FIGS. 1 to 3 positioned above each other.

As explained in the foregoing, the units are combined so that the scissor-like rod pairs in the unit side faces adjoining a neighbor unit is common to the two units whether located in the same panel section or in adjacent sections.

As clearly apparent from FIG. 5, the curved form is obtained as a result of the trapezoidal cross-section shown in FIG. 3 by arranging all units with the same orientation, the front surfaces of the units thereby forming the concave side of the panel as a whole.

FIG. 5 also illustrates the arrangement of posters on the two panel sides. Such posters 100 which may have a standard size of 75×75 cms, for instance, may be secured to the panel in a manner known per se by means of pins secured to the external side of the joints for the arrangement of elastic straps connected with the corners of the posters.

The flexibility with respect to the arrangement of posters may be further improved so that posters in addition to an arrangement with connection to corner joints only may also be arranged to overlap two adjacent units by being secured to the corner joints positioned above each other in the common side face of the two units, on one hand, and to the central joints of the two units, on the other hand. In order to enable such a flexibility, the unit in the embodiment in FIGS. 1 to 3 may be designed so that the two central joints 13 and 26 are positioned at such a distance on each side of the central plane shown in FIGS. 2 and 3 that those central joints in adjacent units which in the curved panel configuration in FIG. 5 are positioned closest to the concave front side of the panel are substantially co-planar with the corner joints between the adjacent units.

Figure 7:
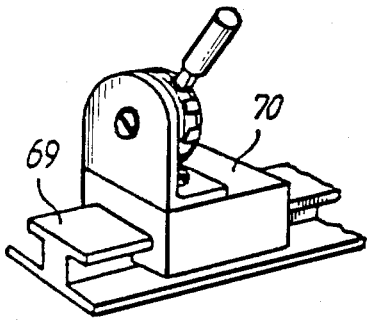
FIG. 7 shows a detail of the panel in FIG. 5 for illustrating a supporting member.

As shown in FIGS. 5 through 7, one or more pairs of opposed corner joints in the lowermost units of the panel may be connected with supporting feet in the form of profiled transverse rails 69. Each of the corner joints in a pair is connected with a shoe member 70 fitting on the profile rail 69 to form a slide displaceable in the longitudinal direction of the rail 69, whereby stops for the movement of the slides 70 are provided at each end and in the central portion of the rail 69. Thereby, the panel as a whole may be supplied with integral supporting feet which when folding the panel to its collapsed form will be turned to extend in parallel relationship with all the rods as a result of the pivotal connections between the corner joints and the shoe members 70.

When folding a panel as shown in FIGS. 4 to 6 having a size of 2.25×3 ms, for instance, to its collapsed condition, the form will be that of a bundle of tubes having a length corresponding to that of the rods in the side faces of the units and a diameter of about 20 cms.

Figure 8:
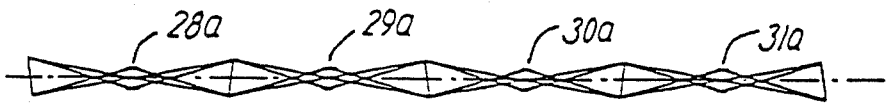
FIGS. 8 and 9 show a flat and a S-shaped panel configuration, respectively, composed of units as shown in FIGS. 1 to 3.
Figure 9:
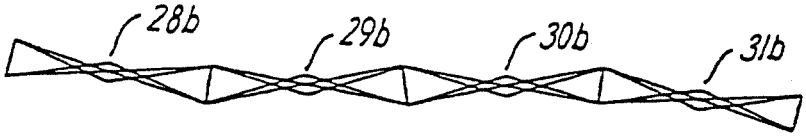

As other examples of panel configurations, FIGS. 8 and 9 show a panel having a flat form and an S-shaped form, respectively, both composed of the same units and panel sections as the curved panel in FIGS. 4 to 6.

The flat form of the panel shown in FIG. 8 is obtained by arranging the panel sections alternately with different orientation of the front and rear surfaces, so that sections 28*a* and 30*a* are arranged with their front surfaces facing the opposite way with respect to sections 29*a* and 31*a*.

The S-shaped configuration shown in FIG. 9 and composed of four panel sections 28*b* to 31*b* may in principle be considered as two curved panels composed of two sections each and assembled with the two central sections 29*b* and 30*b* in flat extention of each other.

Figure 10:
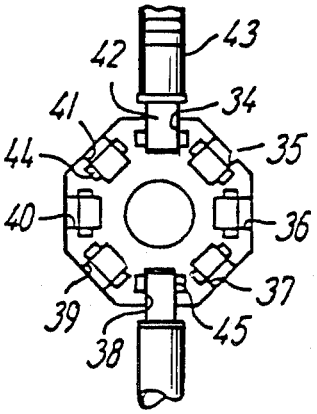
FIGS. 10 and 11 details of a panel unit to illustrate a joint and a locking device, respectively.
Figure 11:
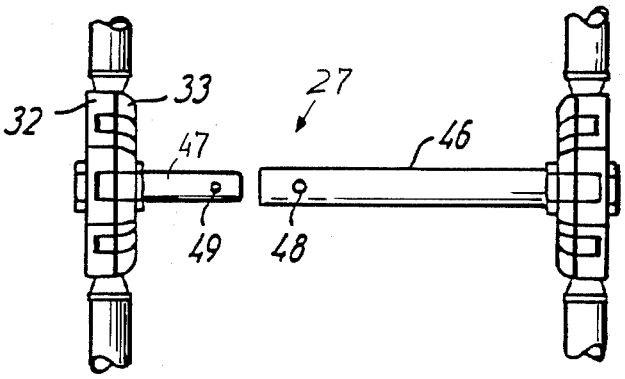

In FIGS. 10 and 11, a preferred embodiment of the corner joints of the unit is shown. In this embodiment, each of the corner joints 5 to 12 in FIGS. 1 to 3 consists of a disc-shaped member having a bottom part 32 and a cover part 33 connected therewith in a snaplike manner. For the accommodation of a maximum number of eight rods in the form of aluminium tubes, the cover part 33 facing the unit surface in question, i.e. the front or rear surface, is formed with a corresponding number of radially extending recesses 34 to 41, which are opened towards the bottom part 32 and towards the circumference of the disc-shaped member. The recesses 34 to 41 serve to accommodate pivot members 42 introduced in the ends of the tubes 43. To secure a rotatable, but radially undisplaceable connection between the joint and the rods, each of the recesses 34 to 41 is formed with two opposite transverse grooves for accommodating two corresponding transverse pins 45 on the pivotal members 42.

By designing the pivotal connection so that the transverse grooves 44 of the recesses 34 to 41 and the transverse pins 45 of the pivotal members 42 are positioned at a distance from the bottom of the recesses and the free ends of the pivotal members, respectively, a controlled function of the pivotal connection is obtained, by which the pivotal movement is limited to take place substantially in an axial plane only relative to the axis of the joint.

The central joints 13 and 26 in the unit shown in FIG. 1 may be designed in the same manner as the corner joints, but need in principle only have four recesses for the accommodation of the pivotal members. However, for reasons of standardization, it will be expedient to use the same design for the corner joints as well as the central joints.

In FIG. 11, the snap locking device 27 shown in FIG. 1 is illustrated in more detail. It is constructed in a simple manner to be composed by two tubular members 46 and 47 secured to the inner side of each of two opposed corner joints and designed to fit one into the other, the locking being established by engagement of a spring-biased pin 48 on the tubular member 46 with a hole 49 in the wall of the tubular member 47.

Independent of the size of the panel, there will only be one locking device of the kind illustrated by the device 27. However, for a number of opposed pairs of corner joints, stable connections in the erected condition of the panel may be formed by means of distance members 27*a*, as shown in FIG. 1.

Figure 12:
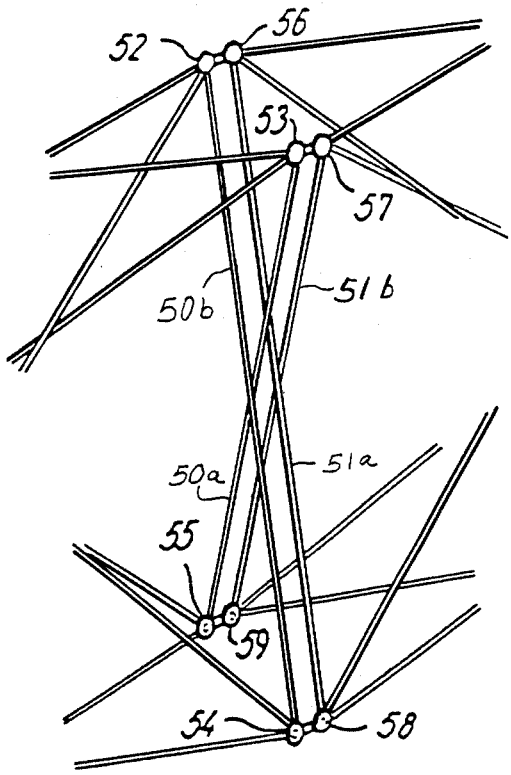
FIG. 12 shows opposed side faces of adjacent units in panel sections forming separate parts in a modified embodiment.

In FIG. 12 a modified embodiment of an exhibit panel according to the invention is shown. The figure shows only one vertical side face of a unit frame as shown in FIG. 1 together with the adjoining side face of an adjacent unit frame. In the modified embodiment, the individual vertical sections of a panel, such as sections 28 to 31 in FIG. 4, are formed as separate structures, so that only adjacent units positioned above each other will have a common scissor-like rod pair in the boundary face between them, whereas adjacent units positioned in juxtaposed relationship in individual ones of the vertical sections of the panel, as shown in FIG. 12, will each have its own scissor-like rod pair 50*a*, 50*b* and 51*a*, 51*b*, respectively, in the vertical side faces facing each other. The two rods of each of the scissor-like pairs positioned opposite each other are connected to corner joints 52 to 55 and 56 to 59, respectively, belonging to each of the two adjacent sections in the same manner as shown in FIG. 1.

In the modified embodiment of the panel, the juxtaposed units or panel sections are connected by means of coupling members connecting the corner joints, such as 54 and 58 in the vertical side faces facing each other.

Figure 15:
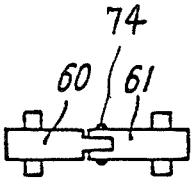
FIG. 15 shows a coupling member for the connection of joints in two adjacent sections.

With a design of the corner joints as shown in FIGS. 10 and 11, such a coupling member may, as shown in FIG. 15, comprise two short tubular members 72 and 61 to be introduced in opposed recesses in the two corner joints according to the principle illustrated in FIG. 10, said members being pivotally connected with each other by means of a releasable pin 74.

However, also other forms of coupling members may be used. Thus, the individual bottom parts of two corner joints to be connected may be replaced by two pivotally connected members, each having the same form as one of the bottom parts to make a snap-fit with the cover part of a corner joint.

Figure 13:
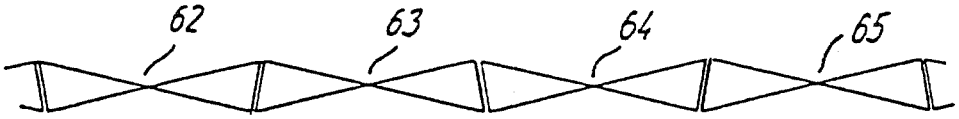
FIGS. 13 and 14 show a flat and a closed panel configuration, respectively, built of panel sections as shown in FIG. 12.
Figure 14:
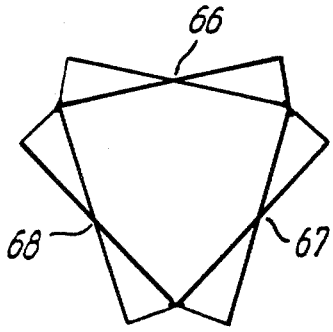

As shown in FIGS. 13 and 14, panels of different configurations may be formed from panel sections designed as separate structures in the same manner as described in the foregoing. Thus, in FIG. 13 a panel is shown comprising four sections 62 to 65 in a flat configuration, in which the corner joints at both sides of the panel are connected by coupling members of the construction shown in FIG. 15, for example.

However, the modified embodiment offers the particular possibility of coupling the corner joints of adjacent section together at one side of the panel only. Thereby, an almost unlimited number of different panel configurations may be formed, such as a completely closed tower-like configuration as shown in FIG. 14, which is composed of three panel sections 66, 67 and 68, adjacent sections of which are coupled together at the corner joints positioned at the rear sides of the units.

We claim:

1. A collapsible lightweight exhibit panel comprising a plurality of square units, each unit formed as a box-like frame having two opposed vertical unit surfaces extending in mainly parallel flat relationship and having horizontal and vertical side faces, each of said side faces being defined by two side rods pivotally connected in a scissor-like manner, each of said vertical unit surfaces being defined by four corner joints with the ends of said side rods being pivotally connected with the respective corner joints, each unit including a central joint and two sets of four substantially extending rods wherein the rods of one set of the sets of diagonally extending rods are pivotally connected at one ends thereof to the respective corner joints defining one of the opposed vertical unit surfaces and are pivotally connected at the opposite ends thereof to the central joint of the unit and wherein the rods of the other set of diagonally extending rods are pivotally connected at one ends thereof to the respective corner joints defining the other of the opposed vertical unit surfaces and are pivotally connected to the respective rods of the one set of diagonally extending rods between the central joint and the associated corner joints of the one set of diagonally extending rods, each unit having corner joints of the four corner joints at one of the unit faces thereof pivotally connected with respective diagonally extending rods of the diagonally extending rods of one or more adjacent units, each unit having a substantially trapezoidal horizontal cross-sectional form in the erected condition with a smaller horizontal distance between the corner joints of one unit surface thereof relative to the other unit surface thereof, each corner joint being detachably connected with all its associated rods, all rods and joints in each unit being located entirely between the unit surfaces thereof in the erected condition of the panel with the pivotal connections between the side rods in the horizontal and vertical side faces as well as the pivotal connections between the diagonally extending rods being positioned substantially in a vertical central plane parallel to the unit surfaces, a snap locking device having a pair of tubular members secured on opposite corner joints of one pair of opposed corner joints and including spring locking means for securing the tubular members together to hold the panel in an erected condition, a plurality of pairs of threaded pins secured to respective pairs of opposed joints distant from the pair of joints supporting the snap locking device, a plurality of tubular members, corresponding to the respective pairs of threaded pins, wherein each tubular member has a pair of coupling nuts at opposite ends for connection with the respective threaded pins of each pair of threaded pins to provide stable connections between a plurality of pairs of opposed joints after provision of the connection provided by the snap locking device.

2. An exhibit panel as claimed in claim 1, wherein each unit includes a second central joint which is likewise located between the unit surfaces, and the rods of each other set of diagonally extending rods have their other ends pivotally connected with the second central joint.

3. An exhibit panel as claimed in claim 2, wherein the central joints are positioned at such a distance from said central plane that in a curved panel structure those central joints in adjacent units positioned closest to the concave front surface of the panel are co-planar with the corner joints between said adjacent units.

4. An exhibit panel as claimed in claim 1 wherein each corner joint comprises a disc-shaped member having a bottom part and a top part connected in a snap-like manner therewith, said top part being provided with eight radially extending recesses for accommodating pivot members in the ends of the rods, each recess being formed with two opposed lateral branches for journalling lateral pins on said pivot members, which lateral branches and pins are separated from the bottom of the recess and the free ends of the pivot members, respectively.

5. An exhibit panel as claimed in claim 1, wherein a number of pairs of opposed corner joints in the lowermost units of the panel are each connected with respective supporting members, each comprising a profiled transverse rail, by means of shoe members connected pivotally with each joint of said pair and being journalled on said rail to form a longitudinally displaceable slide.

* * * * *